US009895598B1

(12) United States Patent
Farris

(10) Patent No.: US 9,895,598 B1
(45) Date of Patent: Feb. 20, 2018

(54) ENHANCED PERSONAL MOBILITY PARK SYSTEM

(71) Applicant: Joy Farris, Arlington, TX (US)

(72) Inventor: Joy Farris, Arlington, TX (US)

( * ) Notice: Subject to any disclaimer, the term of this patent is extended or adjusted under 35 U.S.C. 154(b) by 0 days.

(21) Appl. No.: 15/436,828

(22) Filed: Feb. 19, 2017

Related U.S. Application Data

(60) Provisional application No. 62/297,296, filed on Feb. 19, 2016.

(51) Int. Cl.
*A63C 19/02* (2006.01)
*A63C 19/00* (2006.01)
*A63G 7/00* (2006.01)

(52) U.S. Cl.
CPC ..... *A63C 19/00* (2013.01)

(58) Field of Classification Search
CPC ..... A63G 7/00; A63G 21/00; A63C 19/00; A63C 19/02; A63C 19/08; A63C 19/10; A63C 19/065; A63K 1/00
USPC ..... 472/85–92
See application file for complete search history.

(56) References Cited

U.S. PATENT DOCUMENTS

| | | | | | |
|---|---|---|---|---|---|
| 594,331 | A * | 11/1897 | Crossley | A63C 19/10 | 273/DIG. 31 |
| 3,250,530 | A * | 5/1966 | Dean | A63C 19/10 | 472/90 |
| 4,121,821 | A * | 10/1978 | Graham | A63C 19/10 | 104/63 |
| 4,790,531 | A * | 12/1988 | Matsui | A63C 19/10 | 238/10 R |
| 6,962,534 | B2 * | 11/2005 | Richter | A63C 19/10 | 472/90 |
| 7,594,777 | B2 * | 9/2009 | Chiu | E01C 11/24 | 273/DIG. 31 |
| 8,425,336 | B2 * | 4/2013 | Munzlinger | A63C 19/10 | 404/41 |
| 2003/0013579 | A1 * | 1/2003 | Rennex | A63B 7/04 | 482/37 |
| 2009/0286609 | A1 * | 11/2009 | Dyrdek | A63C 19/10 | 472/89 |
| 2012/0010009 | A1 * | 1/2012 | Sperry | A63B 17/00 | 472/92 |

* cited by examiner

*Primary Examiner* — Kien Nguyen
(74) *Attorney, Agent, or Firm* — Eldredge Law Firm; Richard G. Eldredge

(57) ABSTRACT

An enhanced mobility park system provides a place where those with or attempting to develop skills with a self-stabilizing scooter can gather to develop, demonstrate or enjoy them. The park has a plurality of obstacles each configured to be challenging or entertaining to those will skill in riding self-stabilizing scooters. Obstacles could be a ramp, velocity altering patches, valleys/peaks or the like.

1 Claim, 5 Drawing Sheets

ENHANCED PERSONAL MOBILITY PARK SYSTEM

BACKGROUND

1. Field of the Invention

The present invention relates generally to personal mobility systems, and more specifically, to a public park where people gather to enjoy personal mobility devices and demonstrate their skills with such.

2. Description of Related Art

Public parks are well known in the art and are effective means to provide a location where people gather to use their natural or constructed features to entertain themselves or others. For example, FIG. 1 depicts a conventional public park 101 having a sidewalk 103 that leads to a ramp 105 that a user on a self-stabilizing scooter 107 attempts to navigate. During use, the user 107 rides the scooter 107 along the sidewalk 103 and up the ramp 105 while an observer 109 watches the user on the self-stabilizing scooter 107.

One of the problems commonly associated with park 101 is its limited use. For example, the sidewalk 103 and ramp 105 were not intended to offer challenging and enjoyable obstacles to those skilled in the use of self-stabilizing scooters.

Accordingly, although great strides have been made in the area of public parks, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
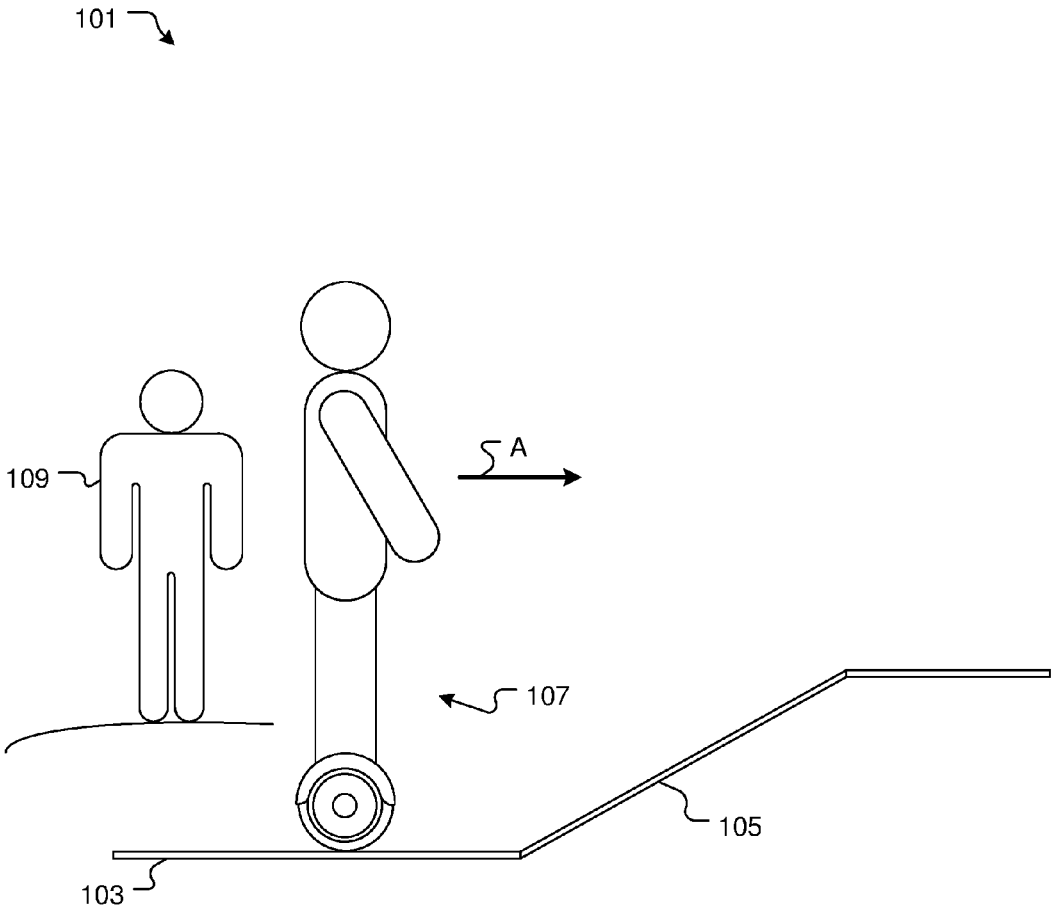
FIG. 1 (Prior Art)
FIG. 1 is a side view of a common public park.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional public parks. Specifically, the system of the present application provides obstacles for those of all levels of skill with self-stabilizing scooters are found in a single location. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
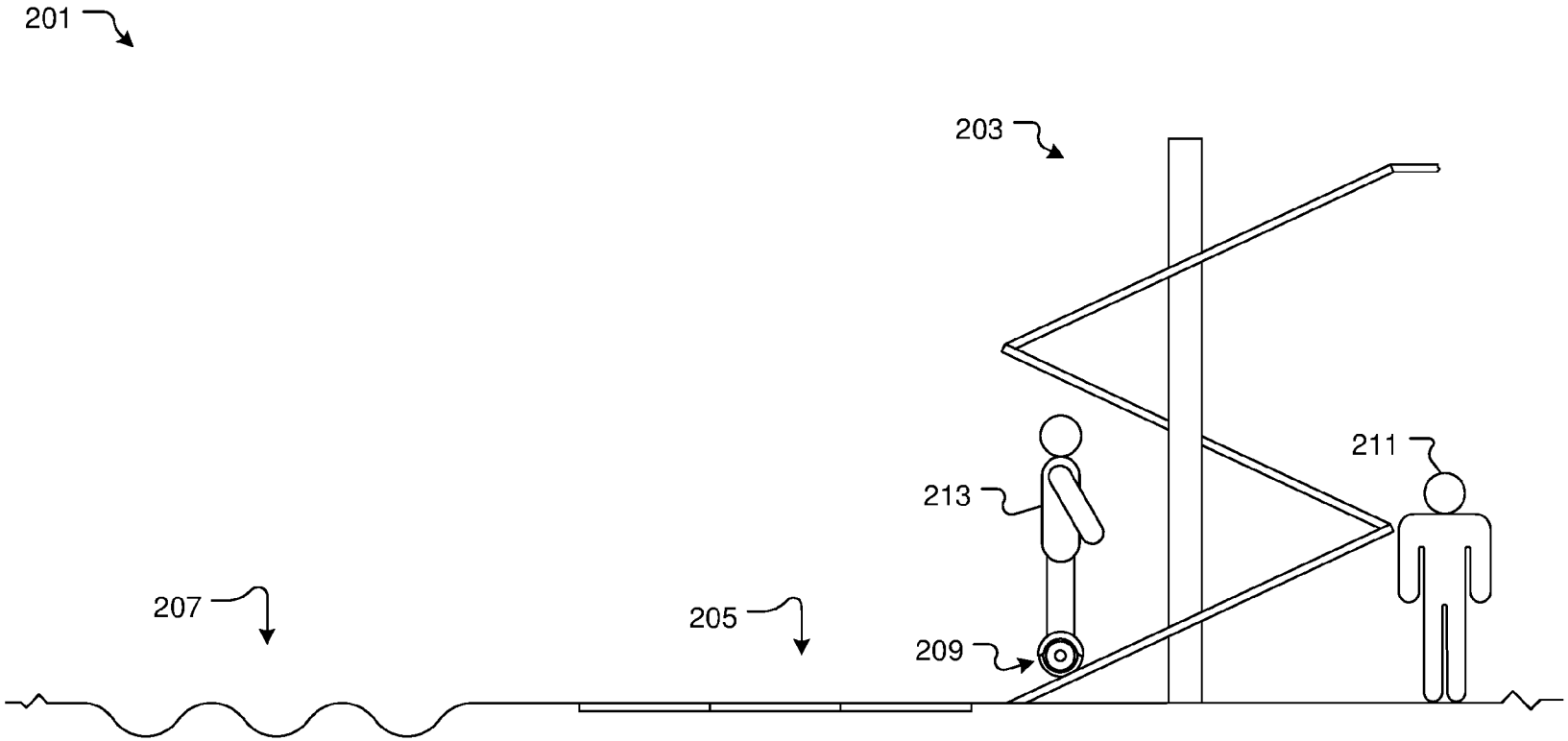
FIG. 2 is a side view of an enhanced personal mobility park system in accordance with a preferred embodiment of the present application.

Referring now to the drawings wherein like reference characters identify corresponding or similar elements throughout the several views, FIG. 2 depicts a side view of an enhanced personal mobility park system in accordance with a preferred embodiment of the present application. It will be appreciated that system 201 overcomes one or more of the above-listed problems commonly associated with conventional public parks.

In the contemplated embodiment, system 201 includes a plurality of obstacles 203, 205, 207 in rolling communication that are configured to require skill or provide enjoyment when traversed by a rider 213 on self-stabilizing scooters 209.

and one or more observers 211.

Figure 3:
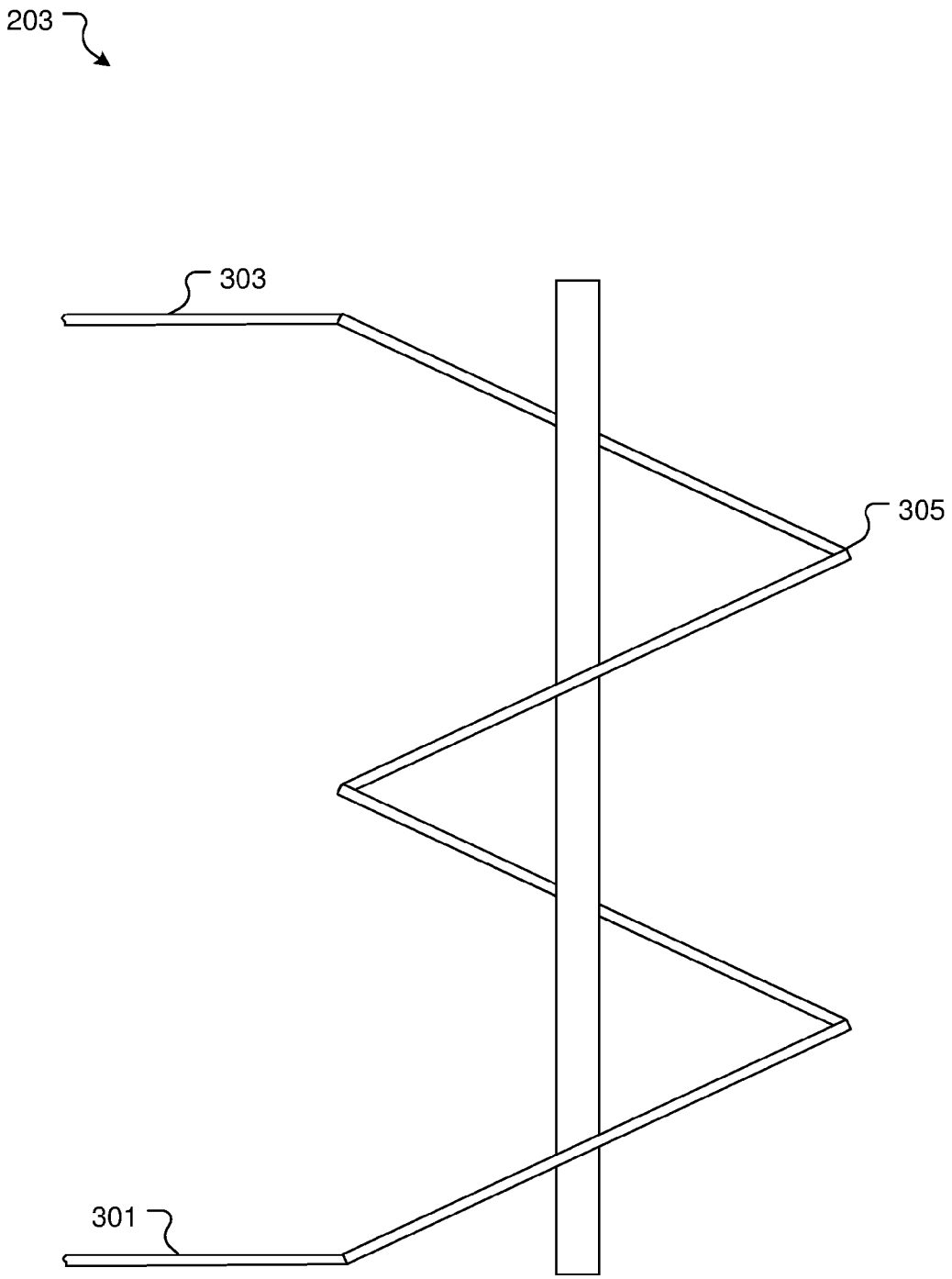
FIG. 3 is a side view of an obstacle of FIG. 2.

Referring now to FIG. 3 the obstacle 203 is depicted, this obstacle a plurality of landings 301, 303, connected by one or more spiral ramps 305. The landings 301, 303 and ramps 305 are configured to require a rider 213 on a self-stabilizing scooter 209 to begin at either landing 301, 303 and adjust their center of gravity with respect to the scooter in order to advance at a controlled rate while also turning in a similar fashion as they traverse the spiral ramp 305. It will be appreciated that the tighter the spiral ramp 305 the more difficult negotiating it will be. It will also be appreciated that this type of obstacle is difficult if not impossible to negotiate on personal mobility devices other than the self-stabilizing scooter 209 because of the performance abilities unique to the self-stabilizing scooter 209.

Figure 4:
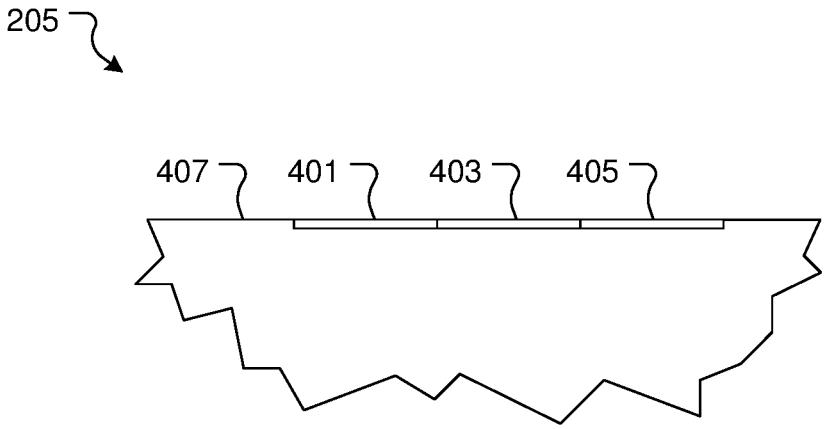
FIG. 4 is a side view of another obstacle of FIG. 2.

Referring now to FIG. 4 where the obstacle 205 is depicted, the obstacle includes a plurality velocity altering patches 401, 403, 405 rigidly attached to each other and integral to a floor 407. The patches 401, 403, 405 are configured to cause change in the speed and/or direction of the rider on the self-stabilizing scooter through friction, surface texture, density or other like attributes. It will be appreciated that this obstacles are counterproductive to other form of personal mobility devices. Examples of these patches 401, 403, 405 are soft foam mat or a bumpy surface. While the patches 301, 303, 305 have been depicted in a successive order it is contemplated that they could be spread apart or be of varying shapes and sizes and not deviate from the intent of this disclosure.

Figure 5:
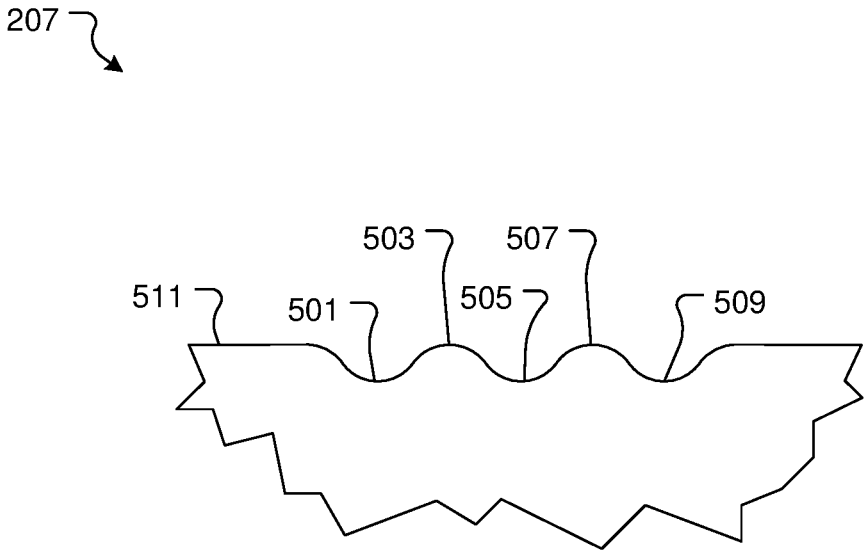
FIG. 5 is a side view of yet another obstacle of FIG. 2.

Referring now to FIG. 5 where the obstacle 207 is depicted, the obstacle includes a plurality of valleys 501, 505, 509 rigidly attached to and separated by a plurality peaks 503, 507 all integral to a floor 511. In use the rider 213 on the self-stabilizing scooter 209 begins at either end 513, 515 and negotiates the valleys 501, 505, 509 and peaks 503, 507. The valleys 501, 505, 509 and peaks 503, 507 are configured to require the rider 213 to continuously adjust their center of gravity with respect to the scooter 209 in order to climb then descend the valleys 501, 505, 509 and peaks 503, 507. It will be appreciated that the valleys 501, 505, 509 and peaks 503, 507 are difficult if not impossible to negotiate on personal mobility devices other than the self-stabilizing scooter because of the performance abilities unique to the self-stabilizing scooter.

In use, each obstacle 203, 205, 207 is navigated or attempted individually. Rider 213 may choose which of the obstacles to attempt and in what sequence if any. The obstacles provide features that test the skills of the rider 213. While the rider 213 navigates the obstacles 203, 205, 207 they are viewed by observers 211.

It should be appreciated that one of the unique features believed characteristic of the present application is the obstacles 203, 205, 207 that develop, test and display skills particular to the use of self-stabilizing scooters 209.

While these obstacles 203, 205, 207 have been depicted it is not meant to limit the scope of this disclosure. It is contemplated that there are various and sundry obstacles that could be arranged together to challenge and give enjoyment to persons on self-stabilizing scooters 209.

Figure 6:
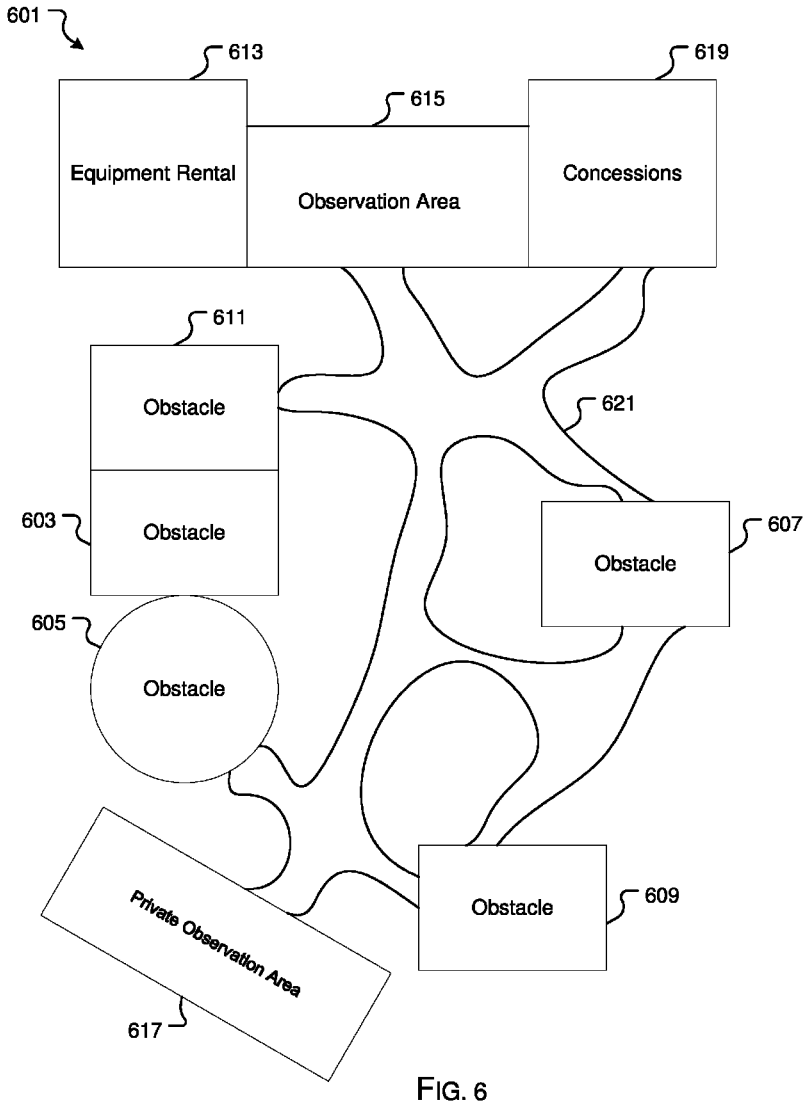
FIG. 6. Is s block diagram of an alternative embodiment of the system of FIG. 2.

An alternative arrangement of the enhanced personal mobility park system is depicted in FIG. 6. Embodiment 601 includes a plurality of obstacles 603, 605, 607, 609, 611 in rolling communication with at least one equipment rental location 613, a plurality of observation areas 615, 617 and at least one concession location 619 via pathways 621. It will be appreciated that while the arrangement is depicted in a single plane it is contemplated that the obstacles 603, 605, 607, 609, 611 and pathways 621 could be on multiple elevations and even above or below each other.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An enhanced mobility park system comprising:

a plurality of obstacles in rolling communication that are configured to test the skills of a rider of a self-stabilizing scooter, each of the plurality of obstacles are tailored specifically for a rider of a self-stabilizing scooter along a pathway, the plurality of obstacles having:

a first ground obstacle along the pathway, the first ground obstacle having:

a first mat having a first length; and a second mat having a second length, the first length is different from the second length, and the first mat is position adjacent to the second mat along the pathway;

wherein both the first mat and the second mat are composed of a foam material;

a plurality of valleys along the pathway; and a spiral ramp along the pathway, the spiral ramp having a landing at a height relative to a ground surface, the spiral ramp is configured to elevate the rider of the self-stabilizing scooter at a height relative to the ground surface.

* * * * *